US011311766B2

(12) United States Patent
Park

(10) Patent No.: US 11,311,766 B2
(45) Date of Patent: Apr. 26, 2022

(54) EXERCISE APPARATUS AND METHOD

(71) Applicant: Kwon Woo Park, Freehold, NJ (US)

(72) Inventor: Kwon Woo Park, Freehold, NJ (US)

( * ) Notice: Subject to any disclaimer, the term of this patent is extended or adjusted under 35 U.S.C. 154(b) by 4 days.

(21) Appl. No.: 16/934,454

(22) Filed: Jul. 21, 2020

(65) Prior Publication Data

US 2022/0023696 A1 Jan. 27, 2022

(51) Int. Cl.

| | |
|---|---|
| ***A63B 21/16*** | (2006.01) |
| ***A63B 69/00*** | (2006.01) |
| ***A63B 21/02*** | (2006.01) |
| ***A63B 21/04*** | (2006.01) |

(52) U.S. Cl.

CPC ..... *A63B 21/028* (2013.01); *A63B 21/0442* (2013.01); *A63B 21/16* (2013.01); *A63B 69/004* (2013.01); *A63B 2209/00* (2013.01); *A63B 2225/05* (2013.01); *A63B 2225/093* (2013.01)

(58) Field of Classification Search

CPC ..... A63B 69/004; A63B 69/20–345; A63B 2225/05; A63B 69/002; A63B 71/03; A63H 33/18; F42B 6/003; F42B 6/02

See application file for complete search history.

(56) References Cited

U.S. PATENT DOCUMENTS

| | | | | |
|---|---|---|---|---|
| 4,216,611 A | | 8/1980 | Psyras | |
| 4,516,947 A | | 5/1985 | Pircher | |
| 4,946,159 A | * | 8/1990 | Jones | A63B 69/004 473/441 |
| 5,803,875 A | * | 9/1998 | Colace | A63B 69/345 473/520 |
| D409,670 S | | 5/1999 | Kuo | |
| D556,841 S | | 12/2007 | Oates | |

(Continued)

FOREIGN PATENT DOCUMENTS

| | | |
|---|---|---|
| CN | 305241233 | 7/2019 |
| GB | 6089366 | 5/2020 |
| GB | 6094245 | 7/2020 |

OTHER PUBLICATIONS

EHowFitness document (derived from: eHowFitness, "Exercises With Cones : Fitness Training Exercises" [online], Mar. 24, 2013 [retreived on Jul. 2, 2021], Youtube.com, Retrieved from: https://www.youtube.com/watch?v=jSjySt1T8LE) (Year: 2013).*

(Continued)

*Primary Examiner* — Joshua Lee
*Assistant Examiner* — Catrina A Letterman
(74) *Attorney, Agent, or Firm* — Walter J. Tencza, Jr.

(57) ABSTRACT

An apparatus including an elongated foam piece first and second ends; and a suction cup attached to the elongated foam piece at the first end. The elongated foam piece may be a cylindrical foam piece. The suction cup is typically removably attached to the elongated foam piece. The apparatus may further include a plate to which the suction cup is removably attached. The plate typically has an outer diameter larger than an outer diameter of the suction cup. The apparatus may include a weight attached to the plate, underneath the plate, opposite from where the suction cup is removably attached to the plate. A plurality of such apparatuses, spaced apart from each other, may be attached to a surface by suction; and a plurality of exercises using each of the plurality of apparatuses may be performed, such as by contacting or weaving in and out of the apparatuses.

11 Claims, 10 Drawing Sheets

(56) References Cited

U.S. PATENT DOCUMENTS

| | | | | |
|---|---|---|---|---|
| 8,246,493 | B1 * | 8/2012 | Ling | A63B 21/169 473/417 |
| D700,261 | S | 2/2014 | Hachiro | |
| D725,730 | S | 3/2015 | Ambrose | |
| 9,039,479 | B1 * | 5/2015 | Green | A63H 33/22 446/46 |
| 9,115,839 | B1 * | 8/2015 | Serrano | A63B 31/00 |
| D825,695 | S | 8/2018 | Kim | |
| D827,311 | S | 9/2018 | Nicoline | |
| D893,642 | S | 8/2020 | Henniger | |
| 10,898,778 | B2 * | 1/2021 | Pack | A63B 69/0071 |
| D919,022 | S | 5/2021 | Yang | |
| 2004/0254035 | A1 * | 12/2004 | Hoffman | A63B 69/0091 473/423 |
| 2005/0003936 | A1 * | 1/2005 | Schwendemann | A63B 69/004 482/87 |
| 2006/0025284 | A1 * | 2/2006 | Livingstone | A63B 69/24 482/83 |
| 2008/0188360 | A1 | 8/2008 | Chu | |
| 2009/0050010 | A1 * | 2/2009 | Tsang | F42B 6/10 102/502 |
| 2009/0264253 | A1 | 10/2009 | Yang | |
| 2014/0128226 | A1 * | 5/2014 | Chang | A63B 71/023 482/83 |
| 2015/0273307 | A1 * | 10/2015 | Karimi | A63B 69/34 482/8 |
| 2015/0328521 | A1 * | 11/2015 | Khunkhun | A63B 69/201 482/87 |
| 2017/0209761 | A1 * | 7/2017 | Magrino | A63B 69/208 |
| 2018/0021650 | A1 | 1/2018 | Hoover | |
| 2018/0051966 | A1 * | 2/2018 | Isenmann | F42B 6/08 |
| 2018/0221745 | A1 * | 8/2018 | Lamark | A63B 69/206 |
| 2018/0304138 | A1 * | 10/2018 | Conley | A63B 69/004 |
| 2019/0184256 | A1 | 6/2019 | Mainini | |
| 2020/0078652 | A1 * | 3/2020 | Scott | A63B 69/206 |
| 2020/0353340 | A1 * | 11/2020 | Arredondo | A63B 69/004 |

OTHER PUBLICATIONS

American Challenge Soccer Sports Coaching Sticks Flags, first available, Dec. 30, 2016, amazon.com [online], site visited Aug. 25, 2021, Available from internet U RL:https:/.

Adjustable Height Hurdle Set 4ft & 5ft, first available Aug. 19, 2020, arnazon.corn [online], site visited Aug. 25, 2021, Available from internet U RL:https://arnzn. to/3gxlb9t.

Gear FC Speed and Agility Turf Training Poles, first available Jun. 11,2020 arnazon.com [online], site visited Aug. 25, 2021, Available from internet URL:https://arnzn.to/3jizq.

Champion Sports Agility Hurdle Set, first available, Jul. 3, 2003, arnazon.corn [online], site visited Aug. 25, 2021, Available from internet URL: https://arnzn.to/3BfDyZH (Year:.

* cited by examiner

EXERCISE APPARATUS AND METHOD

FIELD OF THE INVENTION

This invention relates to devices for exercising.

BACKGROUND OF THE INVENTION

There are various devices known in the art for exercising.

SUMMARY OF THE INVENTION

At least one embodiment of the present invention provides an apparatus comprising: an elongated foam piece having a first end and an opposing second end; and a suction cup attached to the elongated foam piece at the first end of the elongated foam piece.

The elongated foam piece may be a cylindrical foam piece. The suction cup is typically removably attached to the elongated foam piece. The apparatus may further include a plate to which the suction cup is removably attached. The plate typically has an outer diameter which is larger than an outer diameter of the suction cup. In at least one embodiment the apparatus includes a weight attached to the plate, underneath the plate, opposite from where the suction cup is removably attached to the plate.

In at least one embodiment of the present invention a method is provided comprising: attaching a plurality of apparatuses, spaced apart from each other to a surface by suction; and performing a plurality of exercises using each of the plurality of apparatuses, while the plurality of apparatuses are attached to the surface; wherein each of the plurality of apparatuses is comprised of: an elongated foam piece having a first end and an opposing second end; and a suction cup attached to the elongated foam piece at the first end of the elongated foam piece for attaching a corresponding apparatus to the surface. Each of the plurality of apparatuses may be configured as previously described.

The plurality of exercises may be performed by making contact with each of the plurality of apparatuses. The plurality of exercises may be performed by weaving between and around each of the plurality of apparatuses.

In at least one embodiment a method which includes placing a plurality of apparatuses, spaced apart from each other on a ground surface; and performing a plurality of exercises which involve using each of the plurality of apparatuses, while the plurality of apparatuses are on the ground surface. Each of the plurality of apparatuses may be configured as previously described. The plurality of exercises may be performed by making contact with each of the plurality of apparatuses and/or by weaving between and around each of the plurality of apparatuses.

DETAILED DESCRIPTION OF THE DRAWINGS

Figure 1:
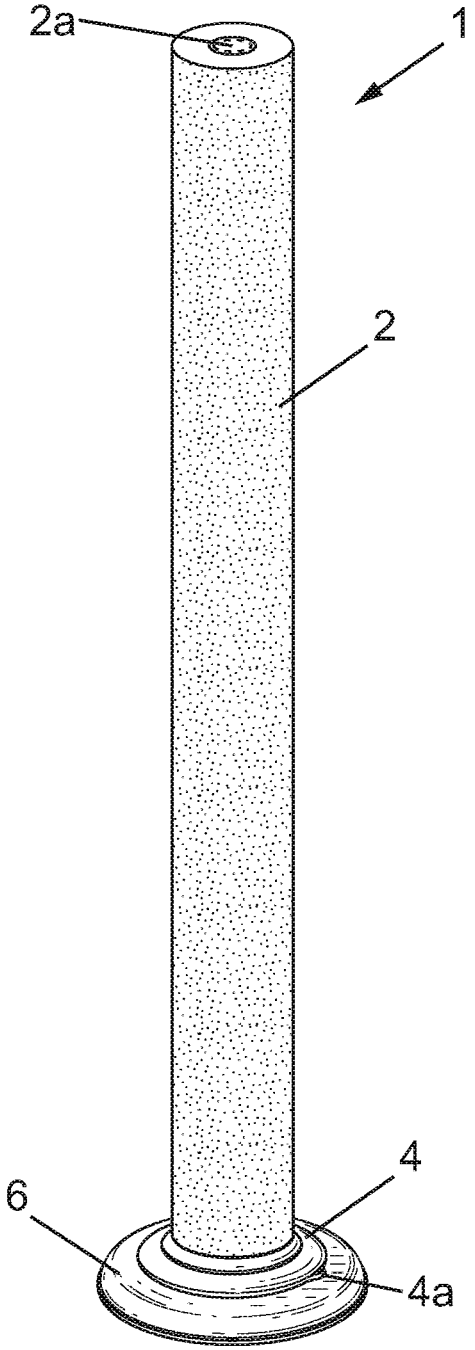
FIG. 1 is a front, and top perspective view of an exercise apparatus in accordance with an embodiment of the present invention, with the exercise apparatus in an assembled state.
Figure 2:
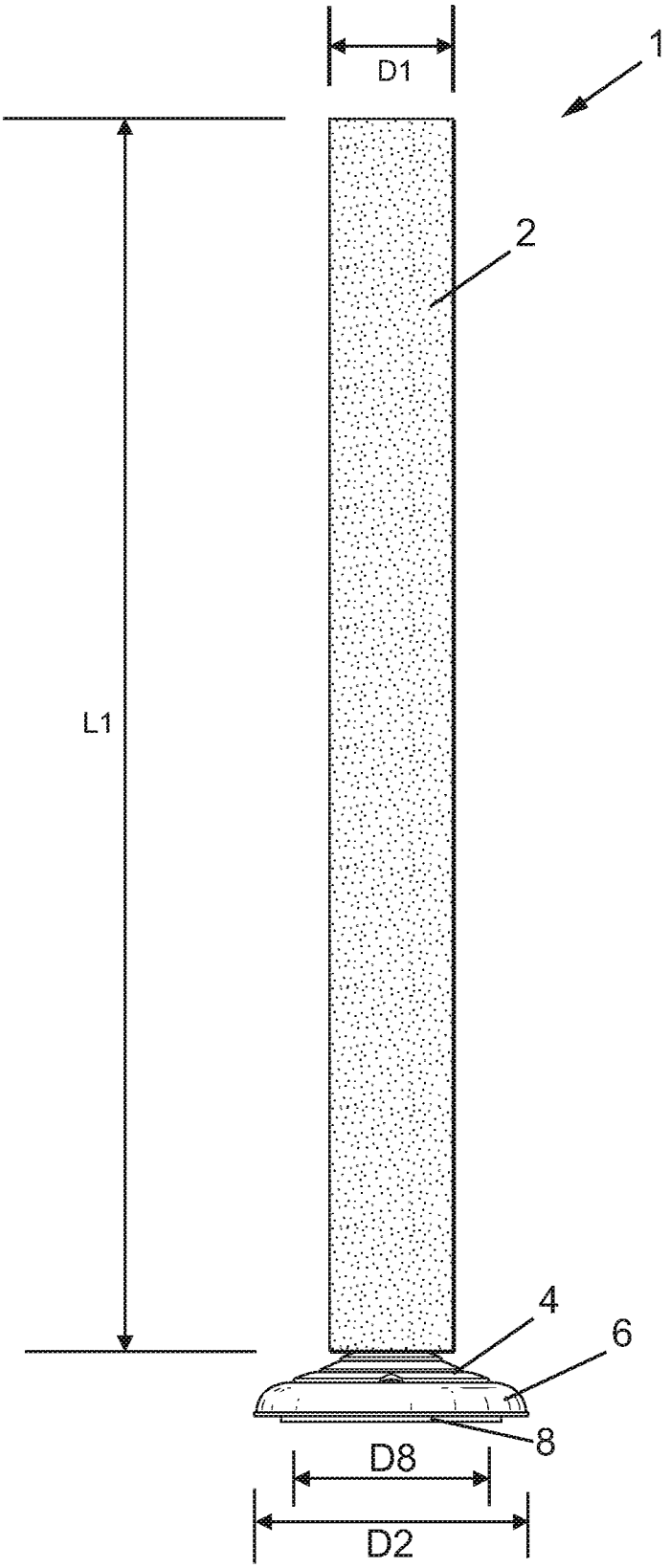
FIG. 2 is a front elevational view of the exercise apparatus of FIG. 1, with the exercise apparatus in an assembled state.
Figure 3:
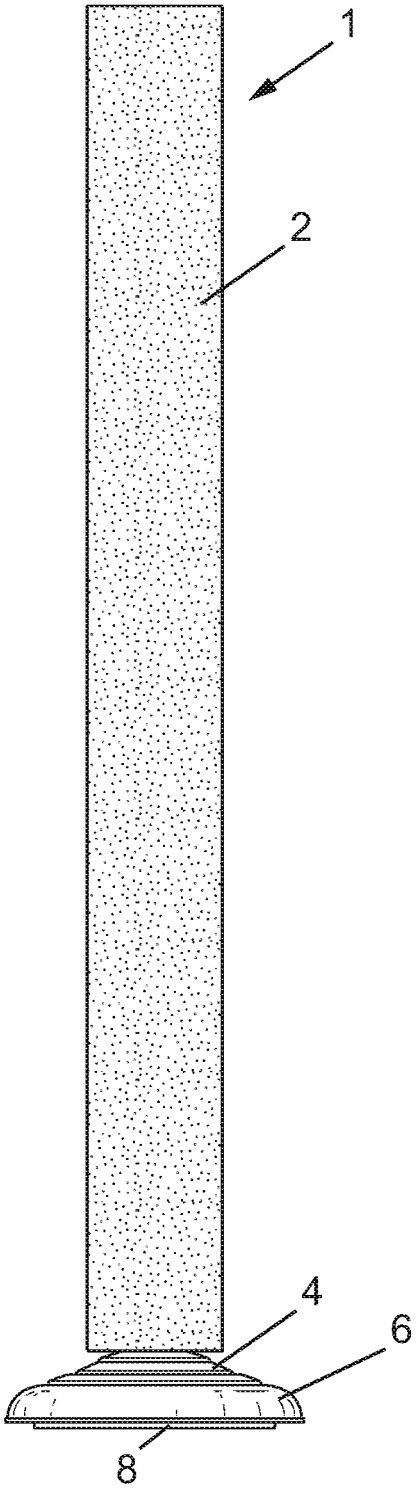
FIG. 3 is a rear elevational view of the exercise apparatus of FIG. 1, with the exercise apparatus in an assembled state.
Figure 4:
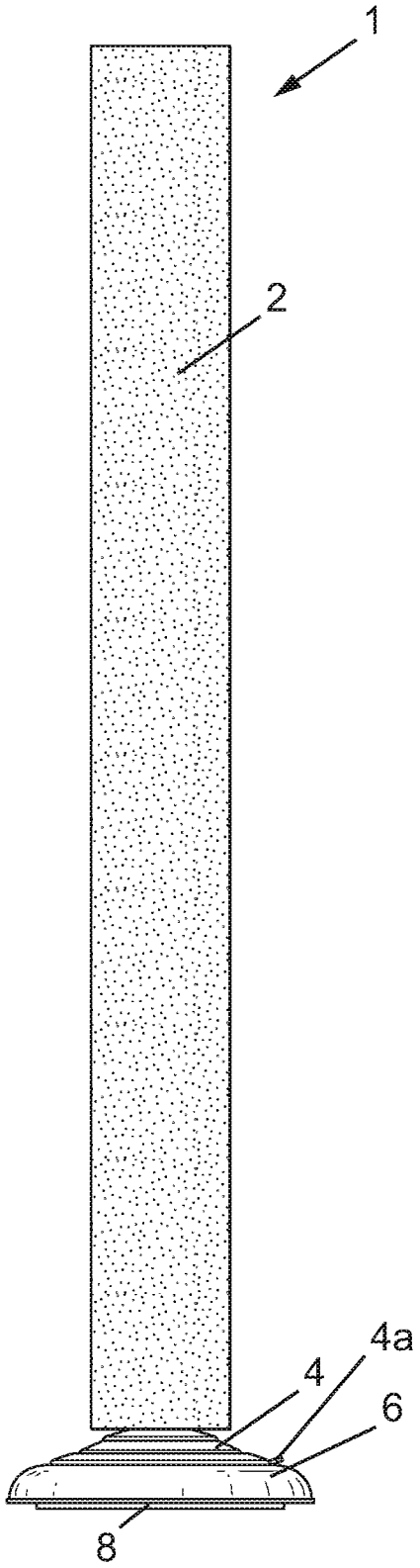
FIG. 4 is a left side elevational view of the exercise apparatus of FIG. 1, with the exercise apparatus in an assembled state.
Figure 5:
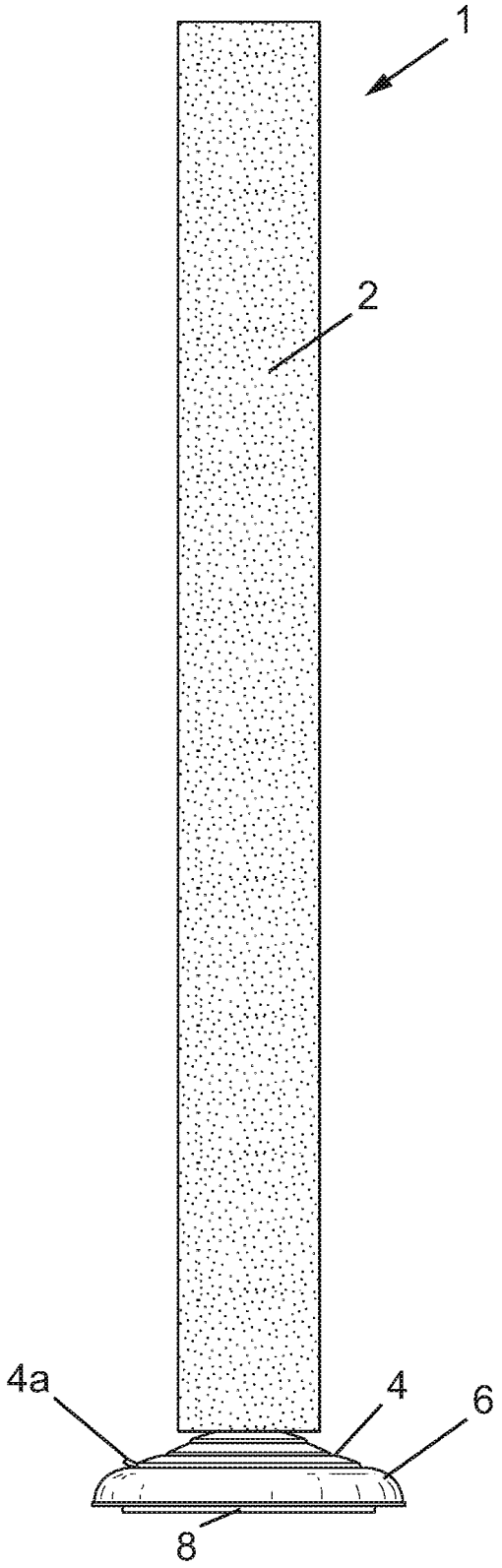
FIG. 5 is a right side elevational view of the exercise apparatus of FIG. 1, with the exercise apparatus in an assembled state.
Figure 6:
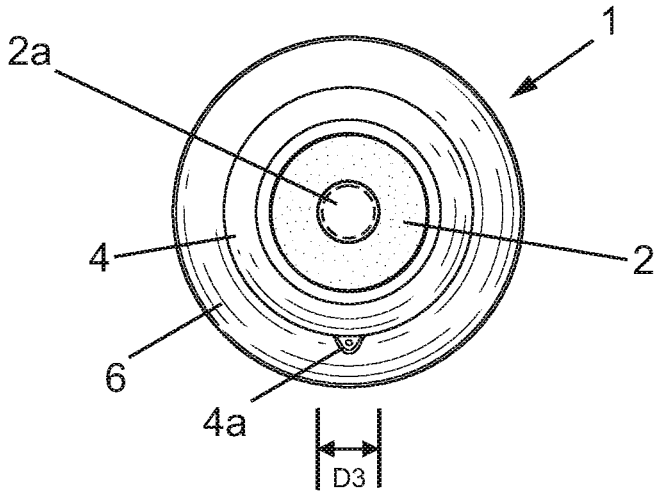
FIG. 6 is a top plan view of the exercise apparatus of FIG. 1, with the exercise apparatus in an assembled state.
Figure 7:
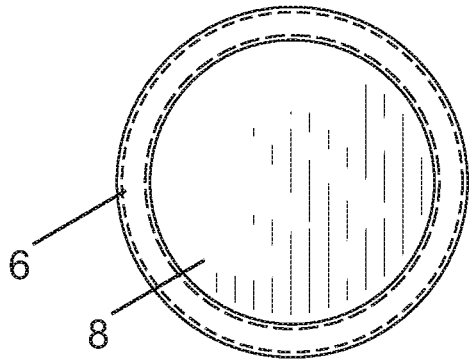
FIG. 7 is a bottom plan view of the exercise apparatus of FIG. 1, with the exercise apparatus in an assembled state.

FIG. 1 is a front, and top perspective view of an exercise apparatus 1 in accordance with an embodiment of the present invention, with the exercise apparatus 1 in an assembled state. FIG. 2 is a front elevational view of the exercise apparatus 1 of FIG. 1, with the exercise apparatus 1 in an assembled state. FIG. 3 is a rear elevational view of the exercise apparatus 1 of FIG. 1, with the exercise apparatus 1 in an assembled state. FIG. 4 is a left side elevational view of the exercise apparatus 1 of FIG. 1, with the exercise apparatus 1 in an assembled state. FIG. 5 is a right side elevational view of the exercise apparatus 1 of FIG. 1, with the exercise apparatus 1 in an assembled state. FIG. 6 is a top plan view of the exercise apparatus 1 of FIG. 1, with the exercise apparatus 1 in an assembled state. FIG. 7 is a bottom plan view of the exercise apparatus 1 of FIG. 1, with the exercise apparatus 1 in an assembled state.

Referring to FIGS. 1-7, the exercise apparatus 1 includes a cylindrical hollow piece 2, a suction device 4, a plate 6, and a weight 8.

In at least one embodiment, it is critical that the cylindrical hollow piece 2 be a pool noodle, such as a cylindrical piece of buoyant polyethylene foam, which is known. The cylindrical hollow piece 2 may have an outer diameter D1 and a length L1, shown in FIG. 2, wherein it is critical in at least one embodiment, that the length L1 be substantially greater than the diameter D1.

The suction device or cup 4 may have an outer diameter of D8 and the plate 6 may have an outer diameter D2 as shown in FIG. 2, wherein it is critical in at least one embodiment, that the outer diameter D8 of the suction device or cup 4 be larger than the outer diameter D1 of the foam piece 2, and smaller than the outer diameter D8 of the plate 6. This allows the suction device or cup 4 to provide more stability when standing on a ground surface or when attached to a side surface, and also allows plate 6 to provide greater stability when standing on a ground surface.

Figure 8:
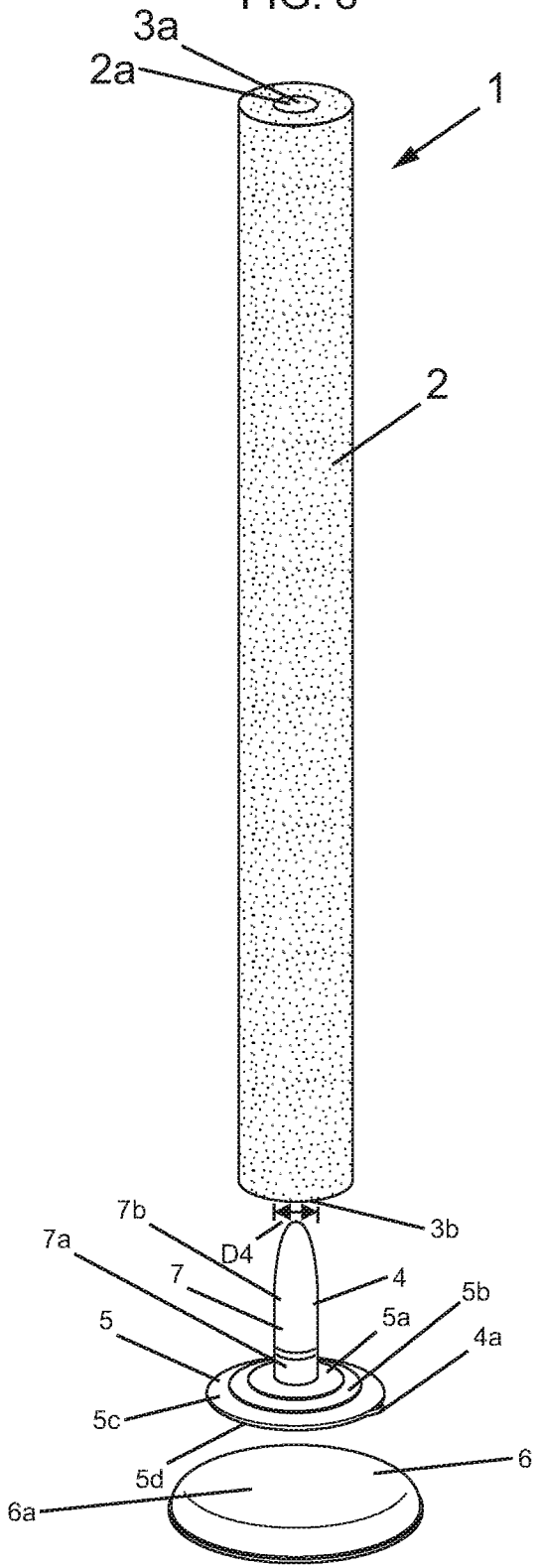
FIG. 8 is a front, and top perspective exploded view of the exercise apparatus of FIG. 1 in accordance with an embodiment of the present invention, with the exercise apparatus shown taken apart.

The cylindrical hollow piece 2 may have an inner cylindrical bore or opening 2*a* running the entire length L1 of the cylindrical hollow piece 2, from an end 3*a* to an end 3*b* as shown by FIG. 8. The bore 2*a* may have an inner diameter D3 shown in FIG. 6.

The suction device 4 is shown in more detail in an exploded view of the apparatus 1 in FIG. 8. The section device 4 includes a base section 5, and a protruding section 7. It is critical in at least one embodiment, that the protruding section 7 be tapered from an end fixed to the base section 5 to an opposite end. The protruding section 7 may include a substantially cylindrical portion 7*a* and a cone portion 7*b* which are integrated together. The diameter of the protruding section 7 at the end nearest end 3*b* of the cylindrical hollow piece 2, typically has a diameter which is less than the inner diameter D3 of the bore 2*a*, so that the end of protruding section 7 nearest end 3*b* can be inserted into the bore 2*a* to thereby insert section 7 partially, substantially, and/or completely into bore 2*a*. The protruding section 7 has a diameter at its end attached to the base portion 5 which may be D4 and which is preferred to be slightly larger than the inner diameter D3 of the bore 2*a*, so that the protruding section 7 and the suction device 4 will be held tightly to the cylindrical hollow piece 2, when the protruding section 7 is inserted into bore 2*a*.

The base 5 of the suction device 4 includes sections 5*a*, 5*b*, and 5*c*. The base 5 also includes an opposite surface or side 5*d*, which is opposite sections 5*a*-5*c*. The surface or side 5*d* attaches to the top surface 6*a* of the plate 6, by suction, to hold the suction device 4 to the plate 6. The plate 6 has a weight attached to a bottom surface opposite to the top surface 6*a*.

The suction device 4 has a tab 4*a*, which can be used to release or detach the suction device 4, and the surface or side 5*d* from the top surface 6*a* of the plate 6.

The suction device 4 is preferably made of a flexible plastic.

The plate 6 is preferably made of a rigid material, such as a rigid or hard plastic, but may be made of metal or wood.

Figure 9:
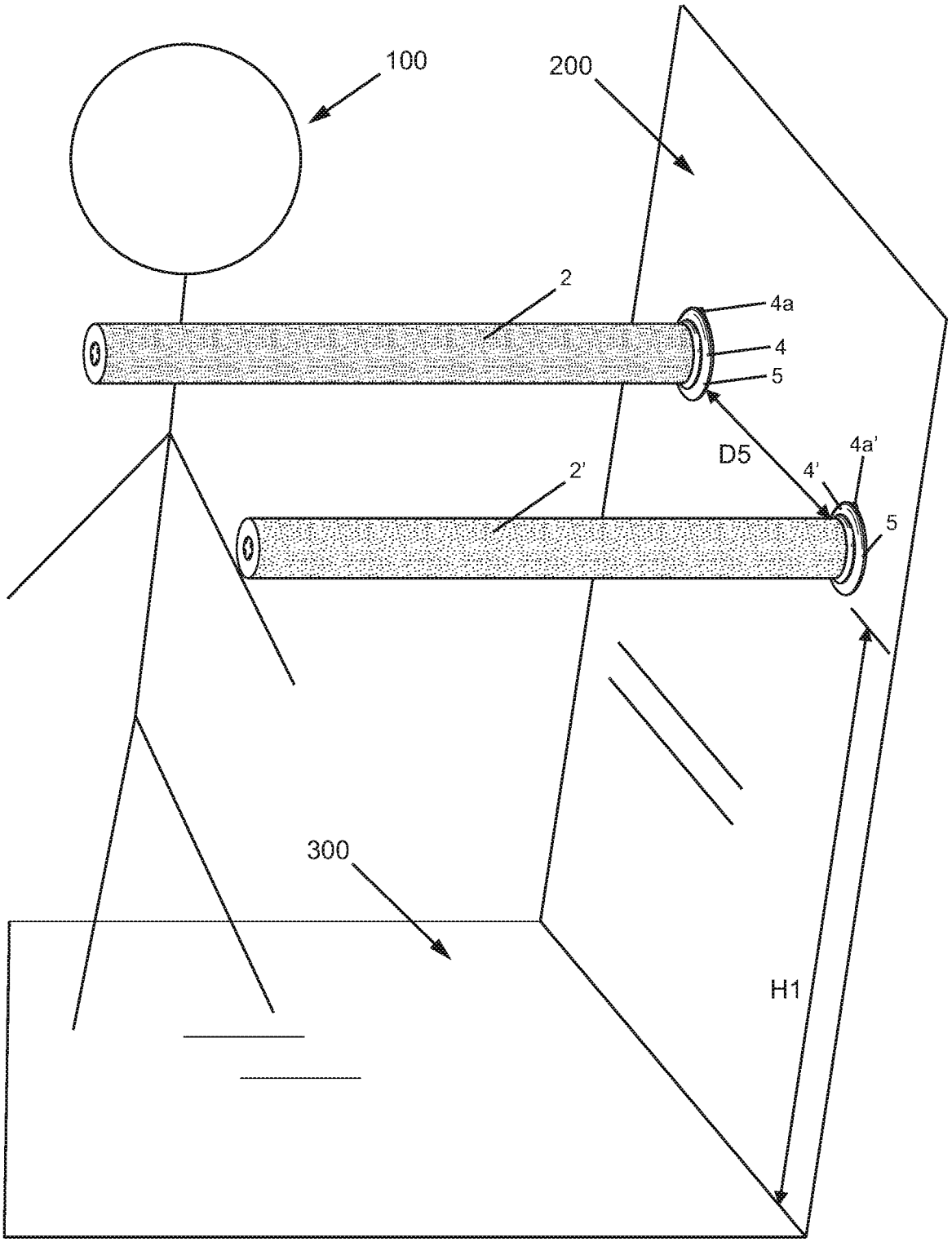
FIG. 9 is a perspective view of two identical apparatuses, each of which includes part of the apparatus of FIG. 1, with the two identical apparatuses shown removably attached to a member, and with a simplified diagram of an individual person shown standing on a floor.

FIG. 9 is a perspective view of two identical apparatuses, each of which includes part of the apparatus 1 of FIG. 1, with the two identical apparatuses shown removably attached to a member 200, and with a simplified diagram of an individual person 100 shown standing on a floor 300.

The two identical apparatuses in FIG. 9, includes a first apparatus which has piece 2, and suction device 4, identical to what is shown in FIGS. 1-8, and a second apparatus which has a piece 2' and a suction device 4' which are identical to the piece 2 and suction device 4. However, the two identical apparatuses in FIG. 9 do not include the plate 6 or weight 8 referred to for FIGS. 1-8. The suction device 4' has a tab 4*a*'. The section device 4' includes a base section 5'.

In operation, an individual 100 may adhere the suction device 4, and piece 2 and the section device 4' and piece 2' as shown in FIG. 9 to the member 200, so that suction devices 4 and 4' are a distance of D5 apart from each other. The distance of D5 may be a little more than shoulder width of the individual 100, such as approximately two feet apart for an average person.

The member 200 may be a piece of glass of a window, a door, or some other surface to which the suction devices 4 and 4' can be removably attached.

With the suction devices 4 and 4' and the pieces 2 and 2', respectively, attached to the member at a height H1 as shown in FIG. 9, the person 100 can execute various exercises, which may relate to martial arts or exercises for sports or exercise activities generally. For example, the person 100 may duck under and between the pieces 2 and 2' or may kick the pieces 2 and 2'. It is critical, in at least one embodiment, that the height H1 is set at a height lower than the height of the individual 100, and the height may be set at waist height of the individual or at shoulder height of the individual depending on the exercise. The height H1, would typically be set lower for drills relating to the individual 100 jumping over the pieces 2 and 2' and higher for drills related to the individual ducking under the pieces 2 and 2'.

Figure 10:
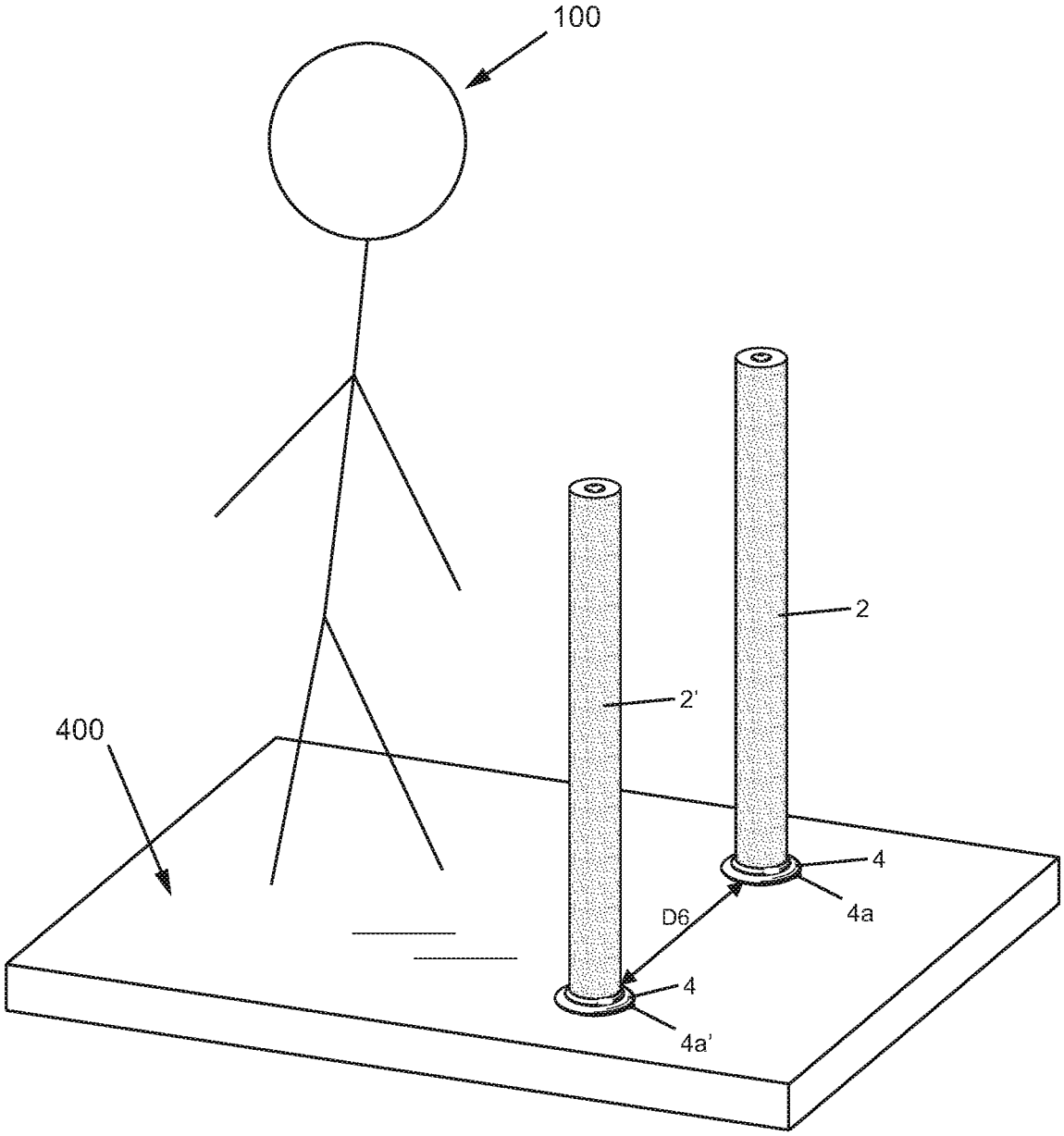
FIG. 10 is a perspective view of the two identical apparatuses shown in FIG. 9, with the two identical apparatuses shown removably attached to a floor, and with a simplified diagram of the individual person standing on the floor.

FIG. 10 is a perspective view of the two identical apparatuses (including components 2 and 4 and 2' and 4') shown in FIG. 9, with the two identical apparatuses shown removably attached to a floor 400, and with a simplified diagram of the individual person 100 standing on the floor 400. The floor 400 may be made of a material such as a plastic mat or matting, to which the such devices 4 and 4' are configured to be attached and/or adhered. The such devices 4 and 4' in FIG. 10 may be attached so that they are about D6 apart which may be about two feet or a little more than shoulder width apart. In operation, the person 100 may run around or in between the pieces 2 and 2' or execute various exercises with respect to the pieces 2 and 2'. For example the person 100 may kick the pieces 2 and 2' or touch the top of one piece 2 and then the other 2'. More than two apparatuses, identical to the combination of components 2 and 4, may be attached to the floor 400, and further exercises may be executed, such as running in and out of the apparatuses in a slalom style. The apparatuses (each of which includes components 2 and 4) may be separated by greater distances, and the person 100 may touch the top of one apparatus (including components 2 and 4) and then run and touch another of the apparatuses (each of which includes components 2 and 4).

Figure 11:
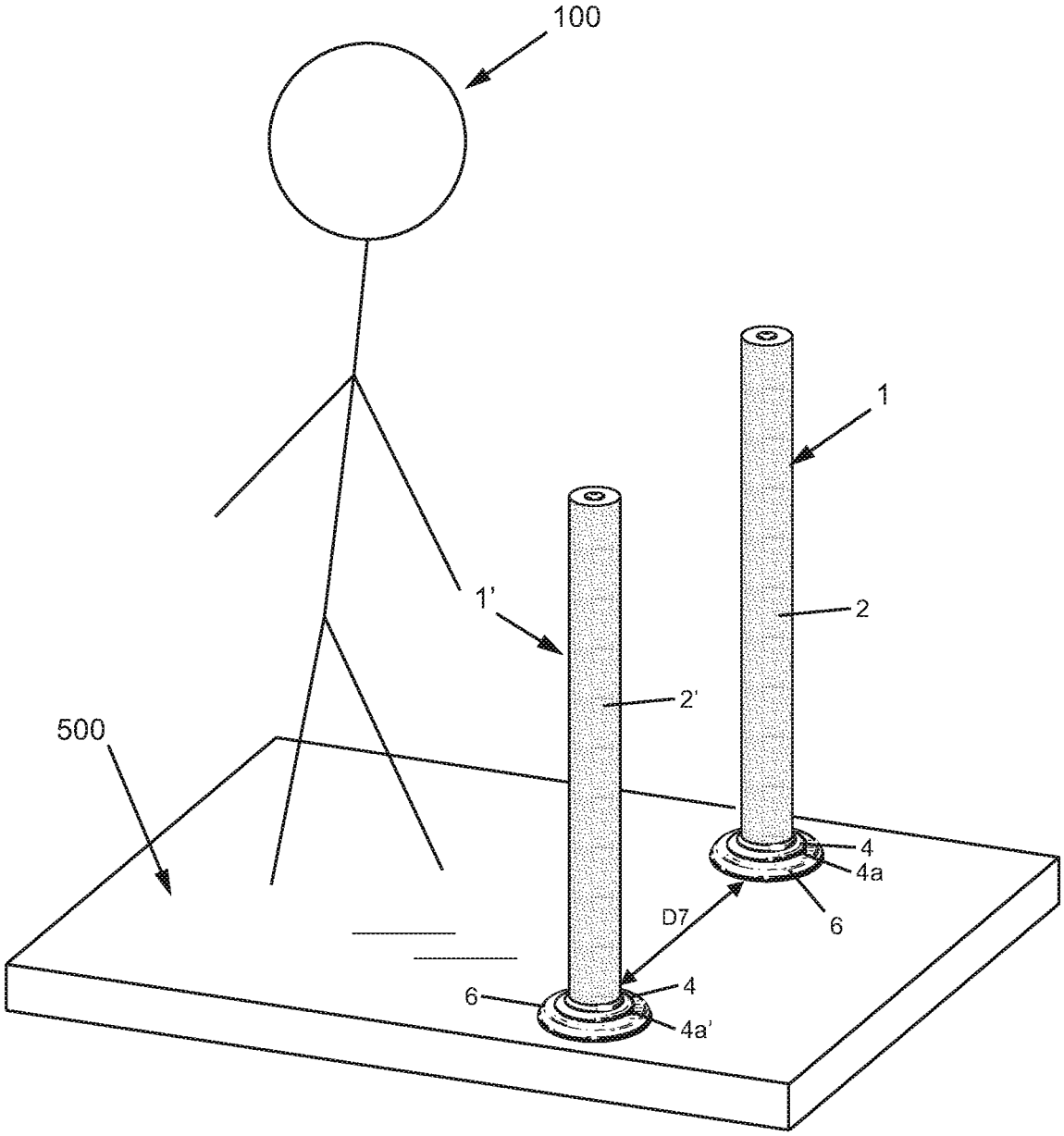
FIG. 11 is a perspective view of the apparatus of FIG. 1, and an identical apparatus to FIG. 1, which are shown placed on a ground surface, and with a simplified diagram of the individual person standing on the ground surface.

FIG. 11 is a perspective view of the apparatus 1 of FIG. 1, and an identical apparatus 1' to FIG. 1, which are shown placed on a ground surface 500, and with a simplified diagram of the individual person 100 standing on the ground surface 500. In FIG. 11, each of apparatuses 1 and 1' includes a plate identical to plate 6 and a weight identical to weight 8. The ground surface 500 may be an outdoor ground surface such as a grass lawn. The exercises referred with reference to FIG. 10, may be executed with the configuration of FIG. 11 as well. The suction devices 4 and 4' in FIG. 11 are shown separated by a distance D7.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

an elongated foam piece having a first end and an opposing second end; and a suction device including a base section and a protruding section;

wherein the protruding section of the suction device has a first end fixed to the base section of the suction device and an opposite second end;

wherein the elongated foam piece has a bore such that the second end of the protruding section is configured to be inserted into the bore of the elongated foam piece to insert the protruding section into the bore of the elongated foam piece to thereby attach the suction device to the elongated foam piece;

wherein the elongated foam piece has an outer diameter; and wherein the base section of the suction device has an outer diameter which is larger than the outer diameter of the elongated foam piece, and wherein the base section lies outside of the bore of the elongated foam piece when the protruding section is inserted in the bore of the elongated foam piece;

further comprising a plate to which the base section of the suction device is configured to be removably attached; and a weight attached to the plate, underneath the plate, opposite from where the base section of the suction device is removably attached to the plate.

2. The apparatus of claim 1 wherein the elongated foam piece is a cylindrical foam piece.

3. The apparatus of claim 1 wherein the protruding section of the suction device is removably attached to the elongated foam piece.

4. The apparatus of claim 1 wherein the plate has an outer diameter which is larger than the outer diameter of the base section of the suction device.

5. The apparatus of claim 1 wherein the protruding section of the suction device has a first diameter at its first end and a second diameter at its second end; and wherein the first diameter is greater than the second diameter.

6. A method comprising:

placing a plurality of apparatuses, spaced apart from each other on a ground surface;

and performing a plurality of exercises which involve using each of the plurality of apparatuses, while the plurality of apparatuses are on the ground surface;

wherein each of the plurality of apparatuses is comprised of:

an elongated foam piece having a first end and an opposing second end;

a suction device including a base section and a protruding section;

wherein the protruding section of the suction device has a first end fixed to the base section of the suction device and an opposite second end;

wherein the elongated foam piece has a bore such that the second end of the protruding section is configured to be inserted into the bore of the elongated foam piece to insert the protruding section into the bore of the elongated foam piece to thereby attach the suction device to the elongated foam piece;

wherein the elongated foam piece has an outer diameter; and wherein the base section of the suction device has an outer diameter which is larger than the outer diameter of the elongated foam piece, and wherein the base section lies outside of the bore of the elongated foam piece when the protruding section is inserted in the bore of the elongated foam piece; and further comprising:

a plate to which the suction device of the corresponding apparatus is removably attached;

wherein each of the plurality of apparatuses includes a weight attached to the corresponding plate, underneath the corresponding plate, opposite from where the corresponding base section of the corresponding suction device is removably attached to the corresponding plate of each of the plurality of apparatuses.

7. The method of claim 6 wherein the elongated foam piece of each of the plurality of apparatuses is a cylindrical foam piece.

8. The method of claim 6 wherein the suction device of each of the plurality of apparatuses is removably attached to the elongated foam piece.

9. The method of claim 6 wherein the plate of each of the plurality of apparatuses has an outer diameter which is larger than an outer diameter of the base section of the suction device of the corresponding apparatus.

10. The method of claim 6 wherein the plurality of exercises are performed by making contact with each of the plurality of apparatuses.

11. The method of claim 6 wherein the plurality of exercises are performed by weaving between and around each of the plurality of apparatuses.

* * * * *